United States Patent [19]

Sundahl

[11] 4,305,160

[45] Dec. 15, 1981

[54] DETENT CONTROLLED HELMET SHIELDS

[75] Inventor: James G. Sundahl, Irvine, Calif.

[73] Assignee: Bell Helmets, Inc., Norwalk, Calif.

[21] Appl. No.: 122,316

[22] Filed: Feb. 19, 1980

[51] Int. Cl.[3] ..... A61F 9/04; A42B 3/02

[52] U.S. Cl. ..... 2/424

[58] Field of Search ..... 2/10, 424, 8, 9, 6

[56] References Cited

U.S. PATENT DOCUMENTS

| | | | |
|---|---|---|---|
| 2,658,200 | 11/1953 | Bowers, Sr. | 2/8 |
| 3,593,338 | 7/1971 | Penny | 2/6 |
| 3,781,914 | 1/1974 | Ramsay | 2/10 |
| 4,070,712 | 1/1978 | Marwitz | 2/10 |
| 4,101,980 | 7/1978 | Stepan | 2/424 X |
| 4,117,553 | 10/1978 | Bay | 2/10 |

FOREIGN PATENT DOCUMENTS

| | | | |
|---|---|---|---|
| 2326156 | 4/1977 | France | 2/424 |
| 2024000 | 1/1980 | United Kingdom | 2/424 |

*Primary Examiner*—Peter P. Nerbun

*Attorney, Agent, or Firm*—William W. Haefliger

[57] ABSTRACT

An adjustable wind shield for a helmet is shiftable between selected positions in which it is held, all in response to rotary pivoting of the shield.

5 Claims, 10 Drawing Figures

DETENT CONTROLLED HELMET SHIELDS

BACKGROUND OF THE INVENTION

This invention relates generally to adjustment of wind shields associated with helmets; more particularly, it concerns method and means to accommodate pivoting of a shield between multiple positions and automatic retention of the shield at each of such position.

Adjustment shifting of transparent wind shields is commonly employed on helmets to allow the user to move the shield into and out of position in front of his eyes. In the past, such shifting presented certain problems, including rubbing and scuffing of the helmet and shield leading to their deterioration; the need for complex adjustment mechanism which then could malfunction in use; and inadequate retention of the shield in selected positions. There is a need for simple, effective shield adjustment means which will automatically hold the shield in selected positions after simple pivoting of the shield to those positions, without scuffing the helmet.

SUMMARY OF THE INVENTION

It is a major object of the invention to provide means to meet the above need. Fundamentally, such means comprises:

(a) a shield, (b) bearing means mounting the shield to the helmet for selective shield pivotal movement between multiple positions, the shield remaining free of engagement with the helmet, (c) detent means on the bearing means and cooperating with the shield to alternately retain the shield in at least two of said positions, in response to pivoting of the shield to said positions.

More specifically, cam and follower elements may be provided in association with the shield and bearing means; the cam may comprise an undulating edge at the border of a cut-out in the shield through which the follower on the shield projects; the bearing means may take the form of a thin plate or disc acting to space the shield end portion from the helmet, and two such bearing plates may be provided at opposite sides of the helmet to prevent rubbing engagement of the shield and helmet; and a spring or springs to maintain yieldable engagement of the cams and followers may be made integral with the bearing plates, as will be seen. Accordingly, a very simple, effective and positive acting detent means is provided in association with bearings for the pivoted shield. Also, snap connection of the shield to the helmet is provided.

These and other objects and advantages of the invention, as well as the details of an illustrative embodiment, will be more fully understood from the following description and drawings, in which:

DRAWING DESCRIPTION

DETAILED DESCRIPTION

Figure 1:
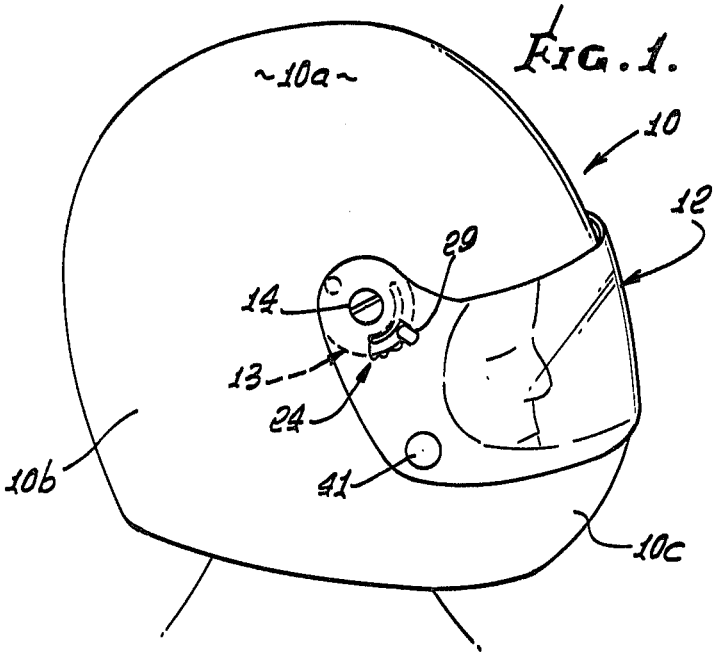
FIG. 1 is a side elevation showing a helmet with a shield in lowered position.
Figure 2:
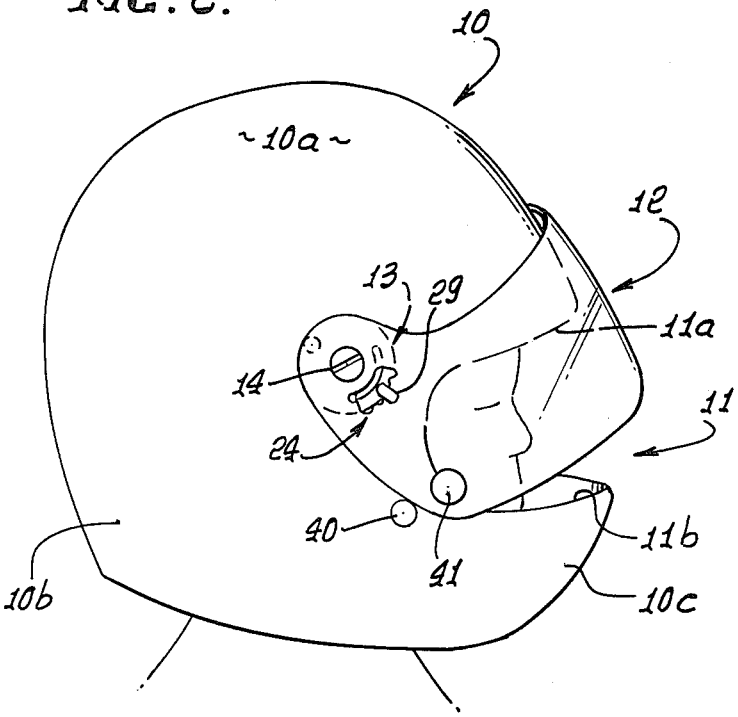
FIG. 2 is a view like FIG. 1, with the shield in partly raised position.
Figure 3:
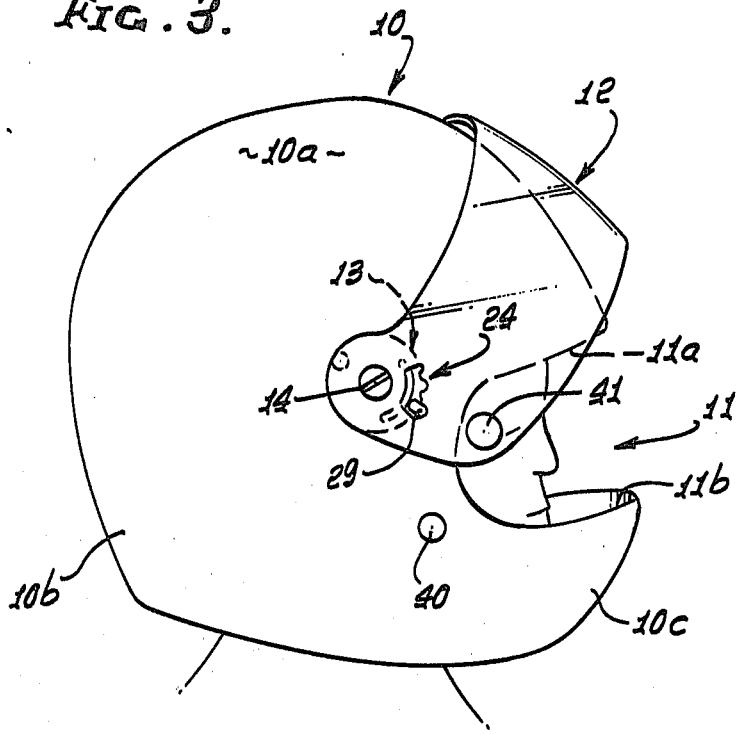
FIG. 3 is a view like FIG. 1, with the shield in fully raised position.

In FIGS. 1–3, a helmet 10, as for example is used by motorcyclist, has a top 10*a*, opposite sides 10*b*, and front 10*c*. The latter is cut-away at 11 in front of the wearer's face. Upper and lower boundaries of the cut-out appear at 11*a* and 11*b*.

Figure 9:
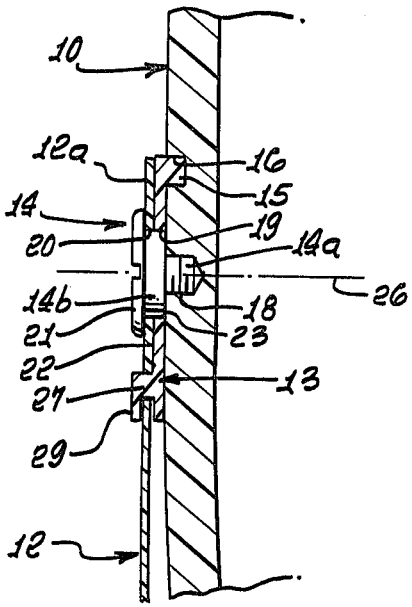
FIG. 9 is an enlarged view showing the bearing unit supported on the helmet and supporting the shield for pivoting.

A shield 12 in the form of a unitary, thin plastic, transparent sheet is curved to extend about the helmet from its front to regions close to but spaced from opposite sides of the helmet. Means is provided to mount the shield to the helmet for selective pivoting between multiple positions, as for example the fully lowered position of FIG. 1 in which the wearer's face is completely protected; the fully raised position of FIG. 3 in which the wearer's face is substantially fully exposed, frontwardly through the cut-away 11; and an intermediate partly raised position as seen in FIG. 2. Such means may advantageously take the form of a bearing plate or disc 13 attached by a fastener 14 to the helmet side, and typically two pairs of such plates and fasteners are provided, one at each outer side of the helmet. Each bearing plate may consist of a thin plastic disc having an integral boss 15 or lug which fits into a drilled hole 16 in the helmet to prevent rotation of the plate or disc. As seen in FIG. 9, the fastener includes a threaded portion 14*a* in threaded engagement with the helmet at 18; an enlarged intermediate cylindrical portion 14*b* fitting in a bore 19 in the disc and also a bore 20 in the shield, and an enlarged head 21 which clamps or retains the shield adjacent the bearing plate. The latter is interposed between the end portion 12*a* of the shield and the helmet to keep the shield from engaging the helmet, i.e. spaced therefrom in all positions. Note that the shield has sliding face to face bearing engagement at 22 with the plate or disc 13, and that the fastener intermediate portion 14*b*, which also acts as a pivot or bearing for the shield, has face to face engagement with the helmet at locus 23.

Figure 7:
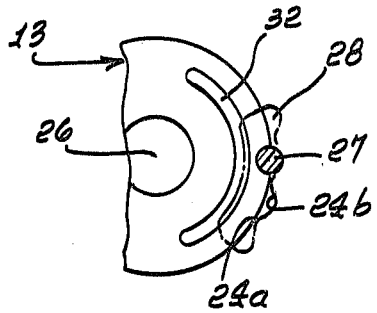
FIGS. 7 and 8 are fragmentary views showing the FIG. 5 unit with the follower thereon in different positions of engagement with a cam carried by the shield.
Figure 8:
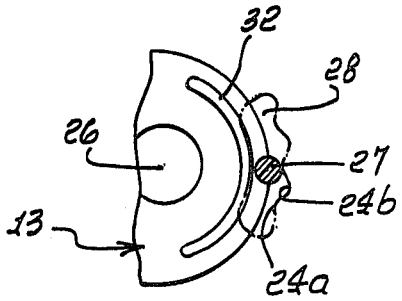
Figure 4:
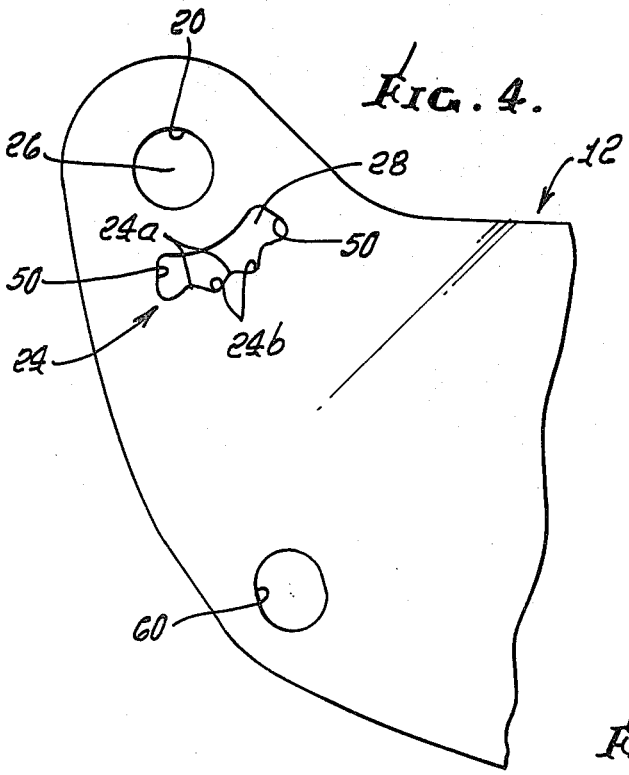
FIG. 4 is a fragmentary view of a portion of the shield seen in FIGS. 1–3.

Also provided are cam and follower elements carried by the helmet to cooperate and provide a detent means to alternately retain the shield in its multiple positions, as for example at least two such positions and preferably in each of the three positions shown in FIGS. 1–3, in response to pivoting of the shield to these positions. One of the elements, as for example the cam element, is positioned on the shield for pivoting movement. As shown, the cam element 24 typically defines a series or sequence of alternating riser and dwell surfaces, 24*a* and 24*b* respectively, which are located between planes defined by opposite main surfaces of the shield. Such surfaces define a sinuously undulating continuous arc surface about the fastener axis, i.e. the axis of pivoting 26. Surfaces 24*a* are closer to axis 26 than surfaces 24*b*, and both are generally circularly spaced about that axis, as is clear from FIG. 4. The follower 27 may advantageously be integral with or carried by the bearing plate, to project laterally therefrom for engagement with the cam element, as is clear in FIGS. 7 and 8 in which the outlines of the cam surfaces 24*a* and 24*b* are shown. The shield may be cut through to form an arc shaped opening 28 to receive the follower, and it is clear that surfaces 24*a* and 24*b* form an undulating edge of that opening, on an arc about axis 26. An extension 29 of the follower overhangs the bearing plate to help retain the follower in position.

Figure 5:
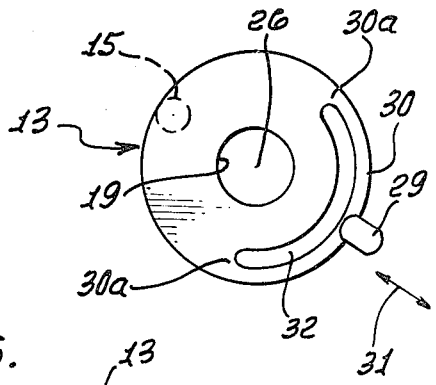
FIG. 5 is a side elevation showing a combination bearing, spring and cam follower unit.
Figure 6:
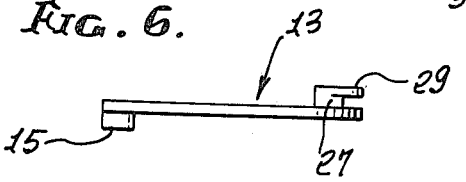
FIG. 6 is an edge view of the FIG. 5 unit.

Further, and in the interests of extreme simplicity of construction, spring means is provided, as for example on the bearing plate, to urge the follower and cam elements into yieldable engagement, with the follower sliding successively along the cam surfaces 24*a* and 24*b* in response to shield pivoting and characterized in that such pivoting is yieldably resisted when the follower engages or drops against the dwell surfaces 24*b*. As shown in the drawings, and particularly FIG. 5, the spring means may have the form of an elongated part 30 which is yieldably bendable, i.e. to flex in and out in the direction shown by arrows 31, so as to urge the follower outwardly (i.e. away from axis 26) into contact with cam surfaces 24*a* and 24*b*. Part 30 is shown as part of plate or disc 13, but separated therefrom by an arc shaped through slot 32, whereby part 30 has opposite ends anchored at 30*a* to the main body of the plate. Part 30 is arcuate relatively narrow, and yieldably flexible, as described. It is anchored to the helmet by the lug or boss 15, but is free of flex relative to the helmet. Such elements are provided at each side of the helmet, so that each of the two opposite ends of the shield is detent connected to the helmet. Follower 27 is located midway between ends 30*a*.

Figure 10:
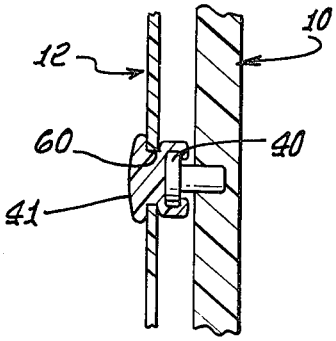
FIG. 10 is a section showing snap connection.

Also, provided are plug and socket components shown at 40 and 41 in FIG. 10, and respectively carried by the helmet and shield. Such components interfit in FIG. 1 position of the shield (for example) to define a releasable snap-connection to positively hold the shield in that position. Such a snap connection may be provided at each of the two end portions of the shield. Note that each socket is carried by the shield 12 as shown, with the shield spaced from the helmet. Openings 60 in the shield receive sockets 41.

Accordingly, a simple effective detenting shield mount is provided, with the shield pivotable between multiple positions in which it is yieldably retained, and the helmet is never gouged by the shield, since the two are always maintained in spaced apart relation.

Stops 50 on the shield 12 limit shield rotation by engagement with the follower.

I claim:

1. In combination with a helmet, (a) a shield, (b) means mounting the shield to the helmet but with the shield everywhere spaced therefrom for selective pivoting movement between multiple positions, and about a pivot axis, (c) a cam element and a follower element, said elements carried by the helmet, one of the elements positioned on the shield for pivoting movement therewith, (d) the cam element defining a succession of alternating riser and dwell surfaces, said riser surfaces generally circularly spaced about said pivot axis and said dwell surfaces also generally circularly spaced about said pivot axis, said riser surfaces located closer to said pivot axis than said dwell surfaces, the entirety of said cam element including said riser and dwell surfaces being located between planes defined by opposite surfaces of the main extent of the shield, (e) and spring means acting to urge said elements into yieldable interengagement, with the follower sliding successively along said surfaces in response to shield pivoting and characterized in that shield pivoting is yieldably resisted when the follower engages said dwell surfaces, (f) said mounting means including a bearing plate anchored to the helmet, the plate also defining said spring means on which said follower is mounted, said spring means extending arcuately about said axis, the follower projecting out of the plane of the plate for selective engagement with said riser and dwell surfaces, the bearing plate having a lug projecting into the helmet in offset relation to said axis.

2. The combination of claim 1 including, (g) stop shoulders limiting said pivoting of the shield, (h) the shield being defined by a transparent plastic sheet that has a cut-out therethrough, said cam surfaces bounding a portion of said cut-out said follower element projecting in said cut-out.

3. The combination of claim 1 wherein said cam and follower elements and said bearing plate are at one outer side of the helmet, and including second cam and follower elements and a second bearing plate which are located at the opposite outer side of the helmet, and which are respectively like said first mentioned cam and follower elements and bearing plate.

4. For combination with a helmet, (a) a shield, (b) means for mounting the shield to the helmet but with the shield everywhere spaced therefrom for selective pivoting movement between multiple positions, and about a pivot axis, (c) a cam element and a follower element to be carried by the helmet, one of the elements positioned on the shield for pivoting movement therewith, (d) the cam element defining a succession of alternating riser and dwell surfaces, said riser surfaces generally circularly spaced about said pivot axis and said dwell surfaces also generally circularly spaced about said pivot axis, said riser surfaces located closer to said pivot axis than said dwell surfaces, the entirety of said cam element including said riser and dwell surfaces being located between planes defined by opposite surfaces of the main extent of the shield, (e) and spring means acting to urge said elements into yieldable interengagement, with the follower sliding successively along said surfaces in response to shield pivoting and characterized in that shield pivoting is yieldably resisted when the follower engages said dwell surfaces, (f) said mounting means including a bearing plate adapted to be anchored to the helmet, the plate also defining said spring means on which said follower is mounted, said spring means extending arcuately about said axis, the follower projecting out of the plane of the plate for selective engagement with said riser and dwell surfaces, the bearing plate having a lug projecting sidewardly thereof for reception in an opening in the helmet, in offset relation to said axis.

5. The combination of claim 4 wherein said cam and follower elements and said bearing plate are adapted to be located at one outer side of the helmet, and including second cam and follower elements and a second bearing plate which are adapted to be located at the opposite outer side of the helmet, and which are like said first mentioned cam and follower elements and bearing plate.

* * * * *